US005570877A

United States Patent [19]

Asami et al.

[11] Patent Number: 5,570,877

[45] Date of Patent: Nov. 5, 1996

[54] PAPER TURNING DEVICE FOR AN IMAGE FORMING APPARATUS

[75] Inventors: Shinji Asami, Hanazono; Yoshiaki Ushirogata, Tokyo; Hiroyuki Ishizaki, Nagoya; Minoru Hattori, Nagoya; Terumitsu Azuma, Nagoya, all of Japan

[73] Assignee: Ricoh Company, Ltd., Tokyo, Japan

[21] Appl. No.: 504,355

[22] Filed: Jul. 19, 1995

[30] Foreign Application Priority Data

Jul. 27, 1994 [JP] Japan ..... 6-175164

[51] Int. Cl.[6] ..... B65H 29/00

[52] U.S. Cl. ..... 271/186; 271/902

[58] Field of Search ..... 271/225, 184, 271/185, 186, 303, 902

[56] References Cited

U.S. PATENT DOCUMENTS

| | | |
|---|---|---|
| 4,762,312 | 8/1988 | Ushirogata . |
| 5,020,784 | 6/1991 | Asami et al. . |
| 5,186,446 | 2/1993 | Saeki et al. . |
| 5,232,210 | 8/1993 | Saeki et al. . |
| 5,362,200 | 11/1994 | Ushirogata . |

FOREIGN PATENT DOCUMENTS

| | | | |
|---|---|---|---|
| 4-4116061 | 4/1992 | Japan | 271/186 |
| 0062146 | 4/1992 | Japan | 271/186 |

*Primary Examiner*—H. Grant Skaggs

*Attorney, Agent, or Firm*—Oblon, Spivak, McClelland, Maier & Neustadt, P.C.

[57] ABSTRACT

In an image forming apparatus, a device for turning a paper of the present invention has a transport roller constantly rotatable in a predetermined direction for paper transport. A reverse transport member is positioned downstream of the transport roller in the predetermined direction, and transports the paper, transported by the transport roller, in the direction opposite to the predetermined direction. A turn guide has a first guide face for guiding the paper toward the transport roller, and a second guide face for guiding in a paper discharge direction the paper being transported by the reverse transport member in the direction opposite to the predetermined direction. The end portion of the first and second guide faces close to the reverse transport member extends in the direction in which the end portion intersects the periphery of the transport roller. Hence, the end portion is angularly retracted by the paper, being guided by the first guide face, to a position coincident with a line tangential to the transport roller. The end of the turn guide is configured such that the first and second guide portions are tapered. The device is miniature and reduces resistance to act on the incoming paper and surely urges it against the transport roller to generate a driving force. As a result, the paper is prevented from being skewed or caught or from jamming the path.

4 Claims, 4 Drawing Sheets

PAPER TURNING DEVICE FOR AN IMAGE FORMING APPARATUS

BACKGROUND OF THE INVENTION

The present invention relates to a device for reversing the transport direction of a paper and applicable to an image forming apparatus.

It is a common practice to provide a copier, printer or similar image forming apparatus with a paper turning device for turning over a paper, carrying an image on one or both sides thereof, and distributing it to a tray or a bin. The conventional paper turning device has, for example, a path selector located at a branch portion thereof. After the trailing edge of a paper has moved away from the path selector, the position of the path selector is switched over to transport the paper in the opposite direction along a transport path terminating at a path selector assigned to a tray or a bin. This path selector drives the paper onto the tray or the bin via a branch path. As a result, the paper is laid on the tray in a turned position. In a paper turning device disclosed in Japanese Utility Model Laid-Open Publication No. 3-107454, for example, the path selector is actuated by a solenoid and has guide faces respectively implemented as a curved surface and a flat surface. When the solenoid is selectively turned on or turned off, either the curved surface or the flat surface of the path selector intersects a transport path or discharge path.

However, the problem with the above paper turning device using a solenoid is that the overall size of the device is apt to increase.

SUMMARY OF THE INVENTION

It is, therefore, an object of the present invention to provide a paper turning device for an image forming apparatus which is miniature and reduces resistance to act on an incoming paper and surely urges it against a transport roller to generate a driving force, thereby preventing the paper from being skewed or caught or from jamming the path.

A device for turning a paper of the present invention has a transport roller constantly rotatable in a predetermined direction for paper transport. A reverse transport member is positioned downstream of the transport roller in the predetermined direction, and transports the paper, transported by the transport roller, in the direction opposite to the predetermined direction. A turn guide has a first guide face for guiding the paper toward the transport roller, and a second guide face for guiding in a paper discharge direction the paper being transported by the reverse transport member in the direction opposite to the predetermined direction. The end portion of the first and second guide faces close to the reverse transport member extends in the direction in which the end portion intersects the periphery of the transport roller. Hence, the end portion is angularly retracted by the paper, being guided by the first guide face, to a position coincident with a line tangential to the transport roller. The end of the turn guide is configured such that the first and second guide portions are tapered.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
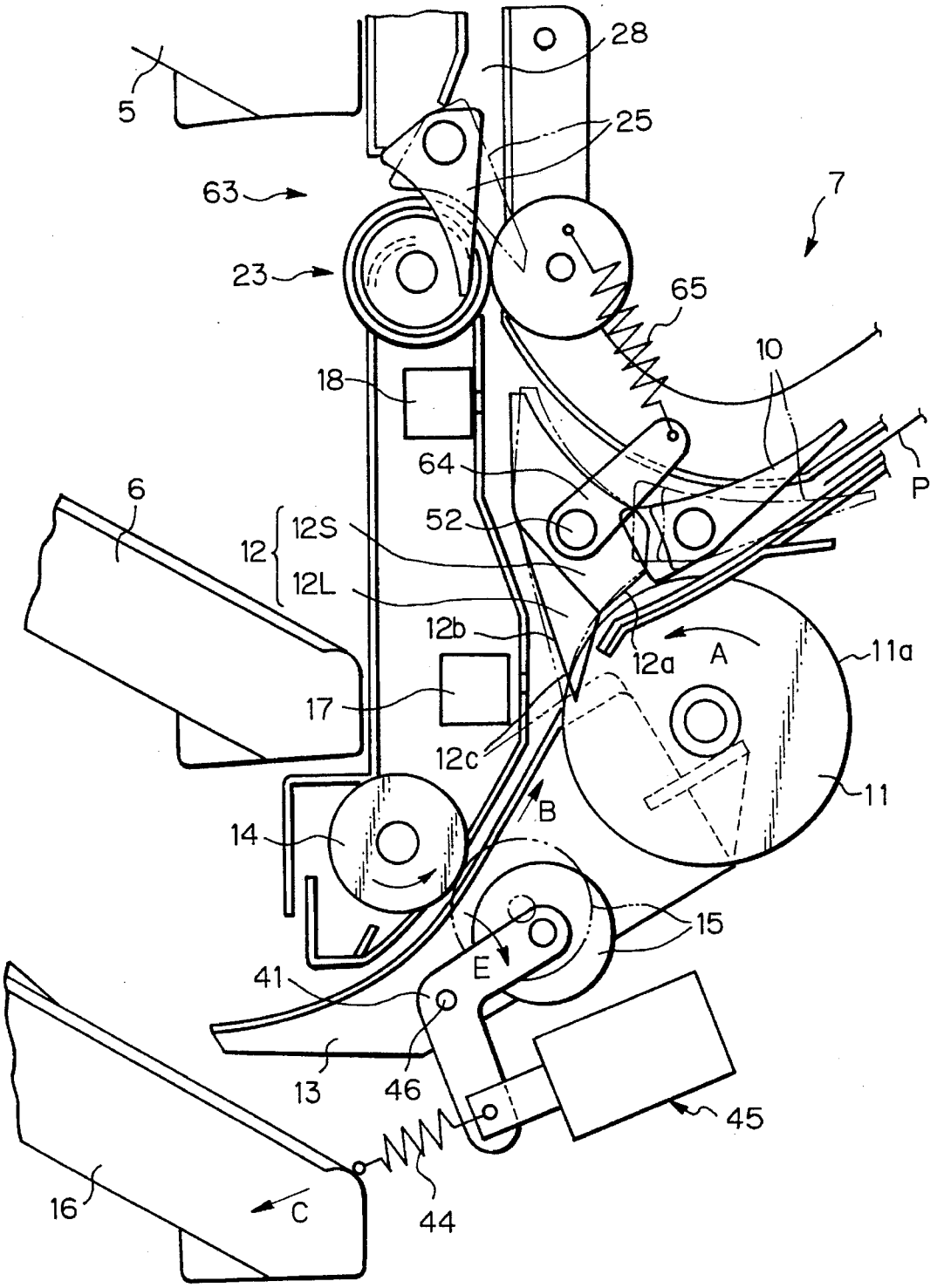
FIG. 1 is a section of a paper turning device embodying the present invention.
Figure 2:
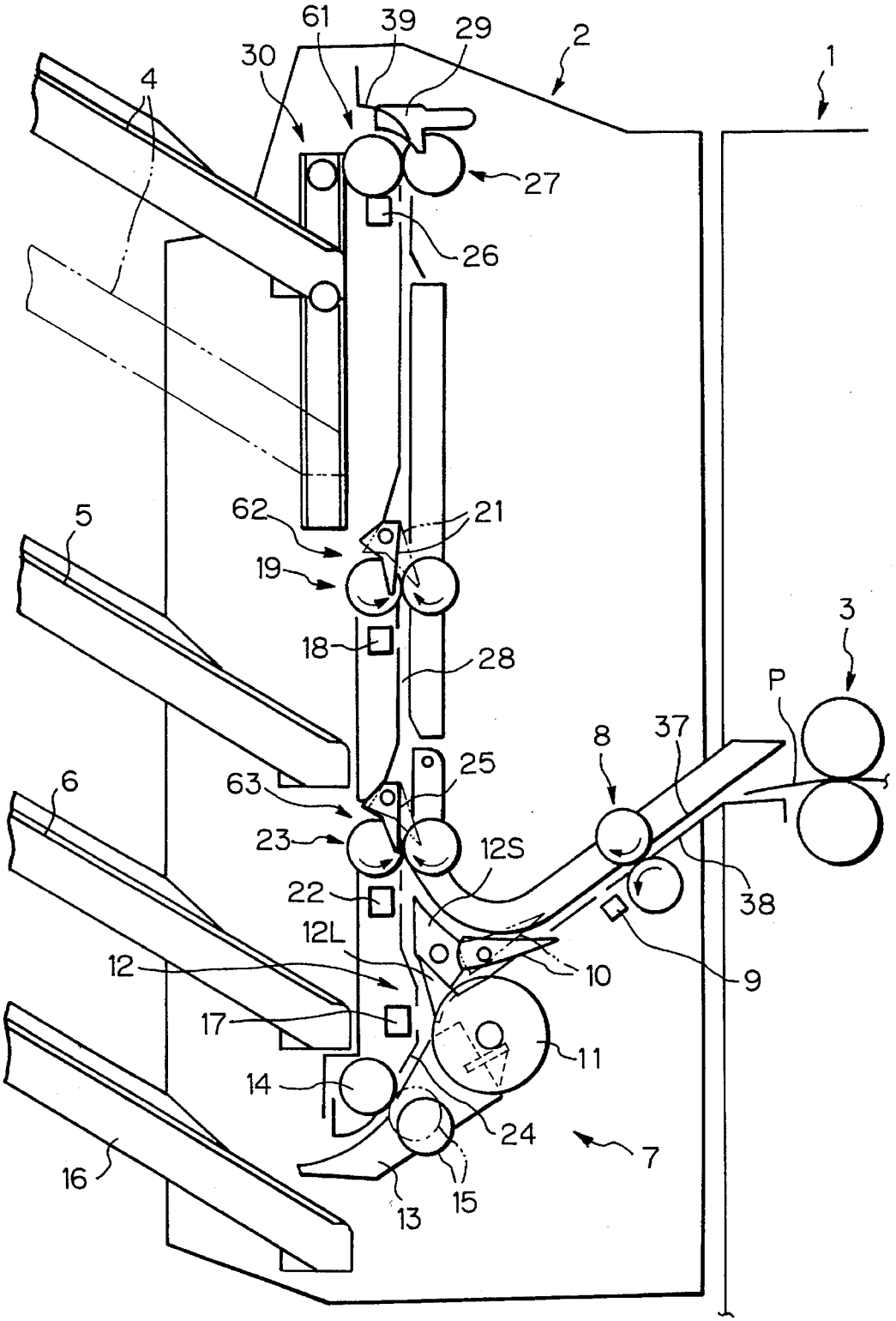
FIG. 2 is a section showing a paper finisher incorporating the device shown in FIG. 1, and implemented as a sorter by way of example.

Referring to FIG. 1 of the drawings, a paper turning device embodying the present invention is shown. The embodiment is applied to a paper finisher implemented as a sorter, as shown in FIG. 2. The sorter, generally 2, is mounted on, for example, one side of a copier, printer or similar image forming apparatus 1 where a paper outlet is positioned. A paper discharge roller pair 3 is disposed in the apparatus 1 in the vicinity of the paper outlet and drives a paper P out of the apparatus 1. An upper and a lower inlet guide 37 and 38 are positioned in the sorter 2 in such a manner as to receive the paper P coming out of the apparatus 1. The sorter 2 capable of distributing the incoming paper P to any one of its bins 4, 5 and 6 without turning it over, or after turning it over with a paper turning device 7 having a switchback mechanism.

As shown in FIG. 2, a pair of inlet rollers 8 are located on a transport path defined by the inlet guides 37 and 38, and each is rotatable in a direction indicated by an arrow. An inlet sensor 9 immediately follows the inlet roller pair 8. The paper turning device 7 is arranged on the transport path downstream of the inlet sensor 9 in the intended direction of paper transport. A path selector 10 is rotatable between two positions indicated by a solid line and a phantom line, respectively. When the path selector 10 is held in the solid line position, the paper P being driven by the inlet roller pair 8 is distributed straight to any one of the bins 4, 5 and 6 along a vertical transport path 28. When the path selector 10 is moved to the phantom line position, the paper P is steered into a turn path 24 and turned over thereby. A turn guide 12 guides the paper P coming out of the turn path 24 to any one of the bins 4, 5 and 6.

A roller pair 19, a path selector 21 and a paper sensor 18 are located on the vertical path 28 and assigned to the second bin 5. Likewise, a roller pair 23, a path selector 25 and a paper sensor 22 are located in the path 28 and assigned to the third bin 6. The rollers 19 and 23 and path selectors 21 and 25 are operated to drive papers P into their associated bins 5 and 6. Further, a roller pair 27, a guide 29 and a paper sensor 26 are assigned to the first or top bin 4. The guide 29 is positioned above the roller pair 27 and provides the paper P to be driven into the bin 4 with elasticity. The paper sensor 26 is positioned beneath the roller pair 27.

The sorter 2 has not only an ordinary sorting or stacking function using the bins 4–6, but also a doggy tail function for stacking papers on the top bin 4 alternately at predetermined intervals. Hence, the sorter 2 further includes an up-down mechanism 30 which maintains the top of sheets stacked on the bin 4 at a fixed level at all times. This successfully enhances the positioning accuracy of papers on the bin 4.

As shown in FIG. I, the paper turning device 7 includes three rollers 11, 14 and 15. The roller or transport roller 11 is rotatable in the paper transport direction (arrow A) at all times. The roller or reverse roller 14 conveys the paper P in a direction B opposite to the direction in which the roller 11 conveys it. In this sense, the roller 14 plays the role of reverse transporting means. The roller or press roller 15 is selectively brought into pressing contact with the reverse roller 14. A generally L-shaped lever 41 is pivotally supported by a shaft 46 at its intermediate portion. The press roller 15 is mounted on one end of the lever 41. A spring 44 is anchored to the other end of the lever 41 and constantly biases the lever 41 in a direction C. A solenoid 45 has a plunger which is also connected to the end of the lever 41 to which the spring 44 is anchored. When the solenoid 45 is energized, it causes the lever 41 to rotate against the action of the spring 44.

Specifically, when the solenoid 45 is not energized, the lever 41 is moved in a direction E due to the action of the spring 44. Hence, the press roller 15 mounted on the lever 41 is spaced from the reverse roller 14, as indicated by a solid line in FIG. 1. When the solenoid 45 is energized, the press roller 15 is brought into pressing contact with the reverse roller 14, as indicated by a phantom line in FIG. 1.

The turn guide 12 is also included in the device 7 and has a first guide face 12*a* and a second guide face 12*b*. The first guide face 12*a* guides the paper P toward the transport roller 11. The second guide face 12*b* guides the paper P being reversely conveyed by the cooperative rollers 14 and 15 in the direction B to any one of outlets 61 (FIG. 2), 62 (FIG. 2) and 63 assigned to the bins 4, 5 and 6, respectively. The end 12*c* of the turn guide 12 where the guide surfaces 12*a* and 12*b* merge into each other extends in a direction in which it intersects the periphery 11*a* of the transport roller 11. When the paper P reaches the first guide face 12*a*, it urges the turn guide 12 to a retracted position where the end 12*c* of the first guide face 12*a* coincides with a line L (see FIG. 3) tangential to the periphery 11*a* of the transport roller 11. The turn guide 12 is made up of a plurality of spaced guide elements affixed to a shaft 52. The guide elements consist of guide elements 12L comparatively long in the paper transport direction, and guide elements 12S comparatively short in the above direction, as will be described later specifically. Let the guide elements 12L and 12S be collectively referred to as guide elements 12 except for some particular cases.

A lever 64 is affixed at its one end to one end of the shaft 52. A spring 65 is anchored to the other end of the lever 6,, at one end and to a stationary member included in the device at the other end. Each guide element 12 is, therefore, constantly biased by the spring 65 to a position indicated by a solid line in FIG. 1. In this condition, each long guide element 12L intersects the periphery 11*a* of the transport roller 11 at its end 12*c*.

Figure 4:
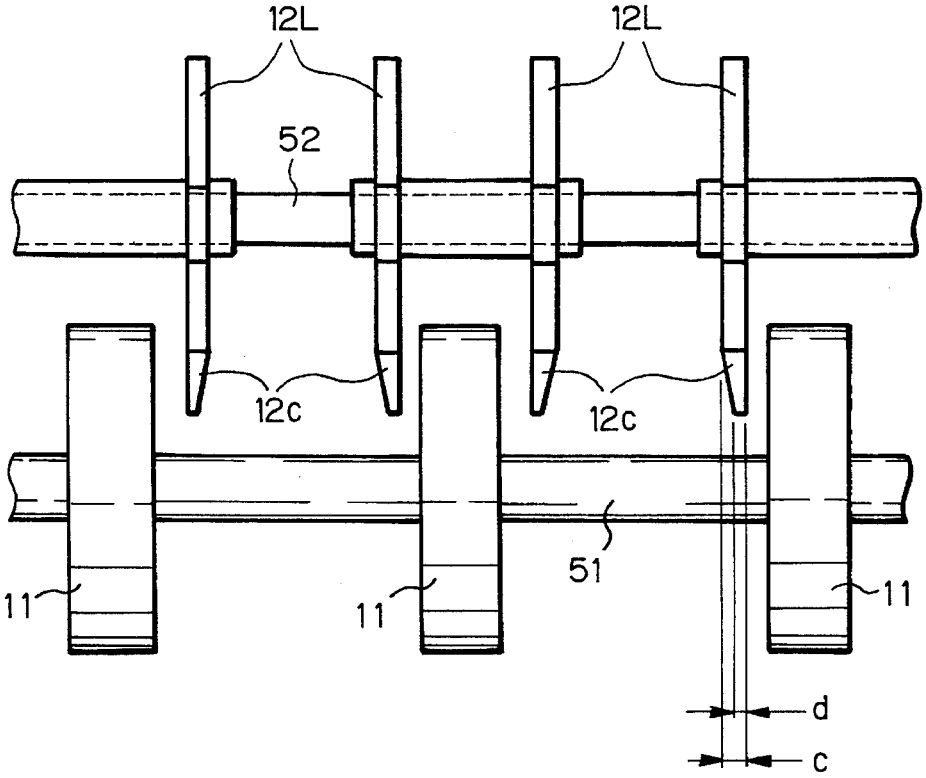
FIG. 4 is a front view showing the transport roller made up of a plurality of roller elements arranged on a single axis, and the turn guide made up of a plurality of guide elements located at both sides of the center roller element and inwardly of the other roller elements.

As shown in FIG. 4, the transport roller 11 is also made up of a plurality of spaced roller elements 11 affixed to a shaft 51. The previously mentioned guide elements 12 are affixed to a shaft 52 parallel to the shaft 51 and positioned at both sides of the center roller element 11 and inwardly of the other roller elements 11 in the axial direction, as illustrated. Each guide element 12 has its end 12*c* close to the reverse roller 14 (lower end as viewed in FIG. 4) tapered at one of opposite sides thereof. Specifically, the end of the guide faces 12*a* and 12*b* (see FIG. 1) has a thickness d smaller than the thickness d of the other portion.

Figure 3:
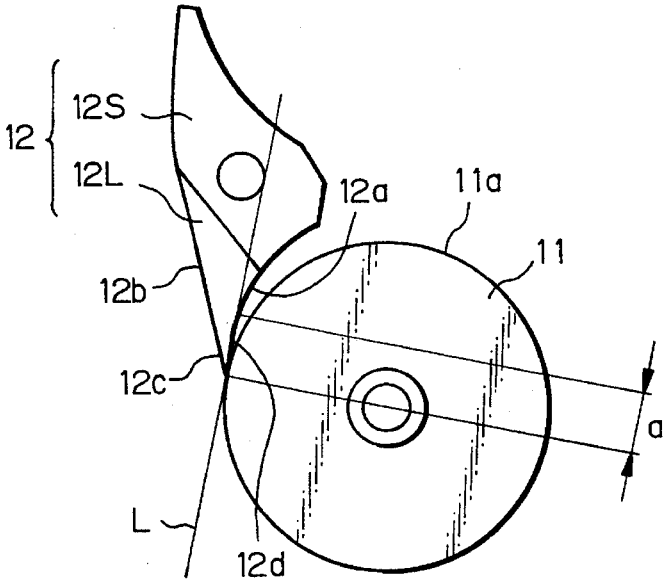
FIG. 3 is a view of a turn guide included in the embodiment and having, at the end thereof, a flat portion coinciding with a line tangential to the periphery of a transport roller.
Figure 5:
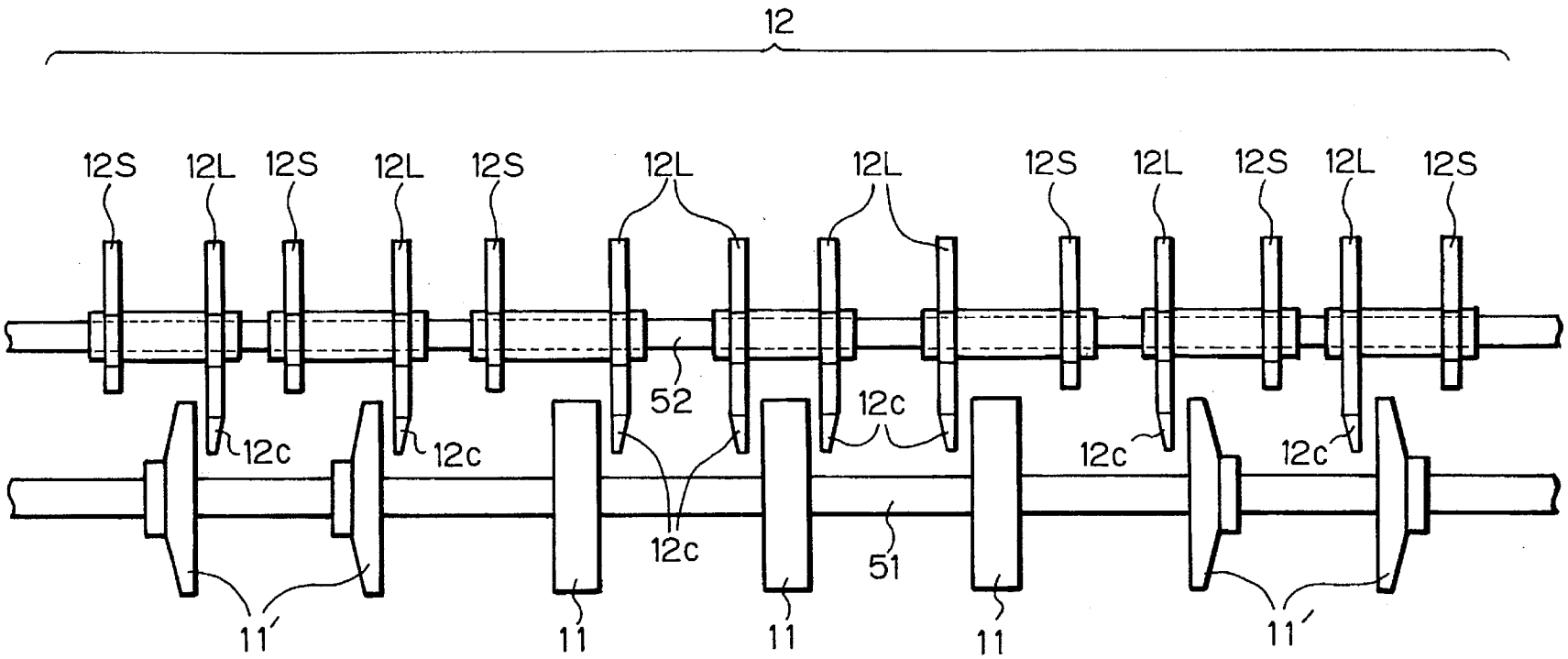
FIG. 5 is a front view showing short guide elements included in the guide elements and not intersecting the peripheries of the roller elements.

As shown in FIG. 3, the long guide elements 12L each has a flat portion 12*d* at the end 12*c* of the first guide face 12*a*. The flat portion 12*d* coincides with the line L, FIG. 3, and extends over a distance a. The long guide elements 12L and short guide elements 12S are arranged on the shaft 52, as shown in FIG. 5. Specifically, two of the long guide elements 12L, intersecting the peripheries of the roller elements 11 at their ends, are positioned symmetrically to each other at both sides of the roller element 11 located at the center of the shaft 51 in the axial direction. The other long guide elements 21L are arranged inwardly of the other roller elements 11 and 11' and symmetrically in the axial direction of the shaft 52. The short guide elements 12S are each positioned substantially at the intermediate between nearby guide elements 12L. In the illustrative embodiment, the three roller elements 11 in the intermediate portion of the shaft 51 are implemented as identical relatively thick rollers, while the other rollers 11' are thinner than and different in shape from the roller elements 11.

The sorter 2 having the above configuration is selectively operable in a straight discharge mode or in a turn discharge mode, as follows. A straight discharge mode operation will be described first. When the paper P is driven out of the image forming apparatus 1 by the roller pair 3, it is guided to the inlet roller pair 8 by the upper and lower inlet guides 37 and 38. At this instant, the roller pair 8 is rotated at a peripheral speed equal to or slightly higher than that of the roller pair 3. Hence, the paper P is smoothly introduced into the sorter 2 without any load acting thereon. After the trailing edge of the paper P has moved away from the roller pair 3 of the apparatus 1, the peripheral speed of the roller pair 8 is raised on the elapse of a predetermined period of time. This is to guarantee an interval between the paper P and the next paper to be driven out of the apparatus 1. The peripheral speed of the roller pair 8 is again lowered before the next paper arrives at the roller pair 8. A control system, not shown, determines these timings by taking account of the time when the leading edge of the paper P moves away from the inlet sensor 9, and a paper size signal to be sent from the apparatus 1.

When the paper P is conveyed by the roller pair 8, the path selector 10 is held in the solid line position shown in FIG. 2. As a result, the paper P is conveyed upward along the vertical path 28, which merges into the bins 4, 5 and 6, by way of the paper sensor 22. Assume that a command for distributing the paper P to the top bin 4 is output. Then, the path selectors 21 and 25 assigned to the second bin 5 and third bin 6, respectively, are held in solid line positions shown in FIG. 2, while the roller pairs 23, 19 and 27 are rotated at the same peripheral speed as the roller pair 8. Consequently, the paper P is conveyed toward the roller 27 associated with the top bin 4. When the paper P is driven into the bin 4 by the roller pair 27 along a guide 39, the previously mentioned guide 29, slightly extending downward beyond the guide surface of the guide 39, causes the paper P to wave in the direction of transport and thereby provides it with elasticity. Further, when the trailing edge of the paper P moves away from the roller pair 27, the roller pair 27 is decelerated. As a result, the paper P is smoothly driven into the bin 4 with accuracy. The control system determines the time for decelerating the roller pair 27 on the basis of the output of the paper sensor 26 and the paper size signal (size data) sent from the apparatus 1.

To drive the paper P into the second bin 5, the roller pairs 19 and 23 are rotated at the same speed as the roller pair 8 in the directions shown in FIG. 2, as when the paper P is distributed to the first bin 4. The path selector 25 is held in the position indicated by a solid line in FIG. 2. On the other hand, the path selector 21 is held in the phantom line position, i.e., protrudes into the path 28 in order to steer the paper P into the bin 5. A lug, protruding from the intermediate portion of the path selector 21, overlaps the roller pair 19 so as to cause the paper P to wave for the same purpose as mentioned in relation to the bin 4. The roller pair 19 is also decelerated when the trailing edge of the paper P moves away from the roller pair 19. Hence, the paper P is driven into the bin 5 as smoothly and accurately as when it is driven into the bin 4. The control system determines the time for decelerating the roller pair 19 on the basis of the output of the paper sensor 18 and the paper size signal (size data) sent from the apparatus 1.

To discharge the paper P into the third bin 6, the above procedure executed with the second bin 5 is repeated except that the paper P is driven into the bin 6 via the outlet 63.

In the turn discharge mode, after the paper P has been reversed in the direction of transport, it is driven into any one of the bins 4–6 in the same manner as in the straight discharge mode. The following description will concentrate on part of the procedure beginning with the transfer of the paper P from the apparatus 1 to the sorter 2 and ending with the reversal of the transport direction.

When the paper P is driven out of the image forming apparatus 1 by the roller pair 3, it is guided to the inlet roller pair 8 by the upper and lower inlet guides 37 and 38. At this instant, the roller pair 8 is rotated at a peripheral speed equal to or slightly higher than that of the roller pair 3. Hence, the paper P is smoothly introduced into the sorter 2 without any load acting thereon. After the trailing edge of the paper P has moved away from the roller pair 3 of the apparatus 1, the peripheral speed of the roller pair 8 is raised on the elapse of a predetermined period of time. This is to guarantee an interval between the paper P and the next paper to be driven out of the apparatus 1. The peripheral speed of the roller pair 8 is again lowered before the next paper arrives at the roller pair 8. The procedure described so far is the same as in the straight discharge mode operation. In this case, the path selector 10 is held in the phantom line position shown in FIG. 2 and steers the paper P toward the turn path 24 of the paper turning device 7.

The paper P enters a wedge-like gap formed by the guide elements 12L and roller elements 11. The lower ends **12*c* of the guide elements 12L, as viewed in FIG. 1, intersect or overlap the peripheries 11*a* of the roller elements 11, and the elements 12L are constantly biased counterclockwise by the spring 65, as stated earlier. Hence, the guide elements 12L urge the incoming paper P against the roller elements 11 which is rotating in the direction A, FIG. 1. As a result, the paper P is driven onto the turn tray 16 while being guided by a guide 13. When the trailing edge of the paper P moves away from the portion where the roller elements 12 and guide elements 12L contact each other, the elements 12L are restored from the phantom line position to the solid line position by the action of the spring 65. The paper P, released from the roller elements 11, is brought to a stop at a position slightly downstream of the end of the guide elements 12L**.

The biasing force of the spring 65 is so selected as not to obstruct the movement of the paper P into the wedge-like gap between the guide elements 12L and the roller elements 11.

When the turn sensor 17 senses the trailing edge of the paper P, the solenoid 45 is energized at a predetermined timing and rotates the lever 41 in the direction opposite to the direction E against the action of the spring 44. As a result, the press roller 15 is shifted from the solid line position of FIG. 1 to the phantom line position where it contacts the reverse roller 14 with the intermediary of the paper P. The rollers 14 and 15 cooperate to reverse the transport direction of the paper P and convey it upward along the vertical path 28. The paper P is, therefore, distributed to any one of the bins 4–6 and laid thereon in a turned position.

In the paper turning device 7, the end **12*c* of the guide faces 12*a* and 12*b* of each guide element 12L and adjoining the reverse roller 14 intersects the outer periphery 11*a* of the adjoining roller element 11, as stated earlier. In addition, the end 12*c* has its side not facing the roller element 11 inclined in a tapering configuration, as also stated previously with reference to FIG. 4. Hence, the paper P, entered the gap between the guide elements 12 and the roller elements 11**, can be surely conveyed and guided without encountering any noticeable resistance.

When the guide elements 12L are urged to the retracted position shown in FIG. 3 by the paper P being conveyed by the roller elements 11, they forms a flat portion (a, FIG. 3) coincident with the line L tangential to the peripheries **11*a* of the roller elements 11, as stated previously. In this condition, the paper P being driven by the roller elements 11 while urging the guide elements 12L upward is free from a degree of resistance obstructing the paper P between the guide elements 12L and the roller elements 11. In addition, the paper P can surely move away from the guide elements 12L** without its leading edge being disfigured.

The turn guide 12 is made up of the guide elements 12L long in the paper transport direction and intersecting the peripheries **11*a* of the roller elements 11, and the guide elements 12S short in the above direction and not intersecting them, for the following reason. For papers of certain sizes, the portions of the long guide elements 12L intersecting the peripheries 11*a* of the roller elements 11 are not always necessary for transport; rather, they are apt to bring about defective transport. The short guide elements 12S do not exert a driving force on such papers between them and the roller elements 11, but they simply guide the papers. With this configuration, the turn guide 12** is capable of coping with a broad range of paper sizes.

Why the long guide elements 12L are positioned inwardly of the roller elements 11 at opposite side edge portions in the paper transport direction, as stated with reference to FIG. 5, is as follows. The paper P is conveyed on the basis of the gap between the guide elements 12L and the roller elements 11 and the elasticity of the paper P. Hence, if the guide elements 12L are positioned outwardly of the roller elements 11 at the above-mentioned portions, it is likely that the paper P loses its elasticity at opposite side edges and fails to move clear of the turn guide 12. When the paper P in such a condition is driven in the opposite direction, there is a fear that it is dog-eared or otherwise deformed.

In summary, it will be seen that the present invention provides a paper turning device for an image forming apparatus and having various unprecedented advantages, as enumerated below.

(1) The device does not include a solenoid or similar actuator and is, therefore, relatively small size. In addition, because the first and second guide faces of a turn guide are tapered, it can surely press an incoming paper against a transport roller while reducing the resistance to act on the paper. The paper is, therefore, prevented from being skewed or caught or from jamming a transport path.

(2) The turn guide has a flat portion coinciding with a line tangential to the transport roller at the end of a first guide face close to reverse transporting means. The flat portion allows the paper to be smoothly transported via a gap between the turn guide and the transport roller. As a result, the paper is prevented from jamming a transport path or from having its surface scratched or otherwise disfigured. The jam occurs, for example, when the paper is caught.

(3) The transport roller and the turn guide respectively have a plurality of roller elements and a plurality of guide elements. The guide elements are positioned at both sides of the center roller element on the axis, and inwardly of the other roller elements on the axis. In this arrangement, the paper, being conveyed by the roller elements, is prevented from loosing elasticity and, therefore, from being dog-eared or caught by the guide elements.

(4) The guide elements include those which do not intersect the outer peripheries of the roller elements, but simply guide the paper. The device is, therefore, capable of coping with a broad range of paper sizes.

Various modifications will become possible for those skilled in the art after receiving the teachings of the present disclosure without departing from the scope thereof.

What is claimed is:

1. A device for turning a paper, comprising:

a transport roller constantly rotatable in a predetermined direction for paper transport;

reverse transporting means positioned downstream of said transport roller in said predetermined direction, and for transporting the paper, transported by said transport roller, in a direction opposite to said predetermined direction; and a turn guide comprising a first guide face for guiding the paper toward said transport roller, and a second guide face for guiding in a paper discharge direction the paper being transported by said reverse transporting means in said direction opposite to said predetermined direction, an end portion of said first and second guide faces close to said reverse transporting means extending in a direction in which said end portion intersects a periphery of said transport roller, whereby said end portion is angularly retracted by the paper, being guided by said first guide face, to a position coincident with a line tangential to said transport roller;

said end of said turn guide being configured such that said first and second guide faces are tapered.

2. A device as claimed in claim 1, wherein said first guide face has in said end portion a flat portion coinciding with said line tangential to the outer periphery of said transport roller.

3. A device as claimed in claim 1, wherein said transport roller comprises a plurality of spaced roller elements arranged on a single axis, wherein said turn guide comprises a plurality of spaced guide elements arranged on a single axis parallel to said axis, and wherein said plurality of guide elements are positioned at opposite sides of one of said plurality of roller elements located at a center of said axis, and inwardly of the other roller elements on said axis.

4. A device as claimed in claim 1, wherein said transport roller comprises a plurality of spaced roller elements arranged on a single axis, wherein said turn guides comprises a plurality of spaced guide elements arranged on a single axis parallel to said axis, and wherein said plurality of guide elements include guide elements which do not intersect peripheries of said plurality of roller elements at end portions thereof close to said reverse transporting means.

* * * * *